US008316657B2

(12) United States Patent
Lifson

(10) Patent No.: US 8,316,657 B2
(45) Date of Patent: Nov. 27, 2012

(54) REFRIGERANT SYSTEM AND CONTROL METHOD

(75) Inventor: Alexander Lifson, Manlius, NY (US)

(73) Assignee: Carrier Corporation, Farmington, CT (US)

( * ) Notice: Subject to any disclaimer, the term of this patent is extended or adjusted under 35 U.S.C. 154(b) by 607 days.

(21) Appl. No.: 12/528,910

(22) PCT Filed: Feb. 28, 2007

(86) PCT No.: PCT/US2007/005162

§ 371 (c)(1), (2), (4) Date: Aug. 27, 2009

(87) PCT Pub. No.: WO2008/105763

PCT Pub. Date: Sep. 4, 2008

(65) Prior Publication Data

US 2010/0101248 A1 Apr. 29, 2010

(51) Int. Cl.
*F25B 41/00* (2006.01)

(52) U.S. Cl. ..... 62/113; 62/513

(58) Field of Classification Search ..... 62/113, 62/115, 498, 513, 197, 217, 223, 222, 126, 62/157; 700/275, 276
See application file for complete search history.

(56) References Cited

U.S. PATENT DOCUMENTS

| | | | | |
|---|---|---|---|---|
| 4,878,818 | A | 11/1989 | Shaw | |
| 4,938,029 | A | 7/1990 | Shaw | |
| 4,938,666 | A | 7/1990 | DeSantis et al. | |
| 5,095,712 | A * | 3/1992 | Narreau | 62/113 |
| 5,598,718 | A | 2/1997 | Freund et al. | |
| 6,047,556 | A | 4/2000 | Lifson | |
| 6,058,729 | A * | 5/2000 | Lifson et al. | 62/217 |
| 6,619,062 | B1 | 9/2003 | Shibamoto et al. | |
| 6,758,054 | B2 * | 7/2004 | Zheng et al. | 62/199 |
| 6,955,059 | B2 | 10/2005 | Lifson et al. | |
| 7,055,262 | B2 * | 6/2006 | Goldberg et al. | 34/86 |
| 2004/0093880 | A1 * | 5/2004 | Zheng et al. | 62/199 |
| 2004/0118138 | A1 | 6/2004 | Nakatani et al. | |
| 2004/0206110 | A1 | 10/2004 | Lifson et al. | |
| 2005/0126190 | A1 * | 6/2005 | Lifson et al. | 62/129 |
| 2006/0037336 | A1 * | 2/2006 | Bush | 62/197 |
| 2007/0130973 | A1 * | 6/2007 | Lifson et al. | 62/196.3 |
| 2008/0016903 | A1 * | 1/2008 | Artsiely | 62/476 |
| 2008/0078192 | A1 * | 4/2008 | Ignatiev et al. | 62/184 |
| 2008/0173034 | A1 * | 7/2008 | Shaw | 62/160 |

FOREIGN PATENT DOCUMENTS

CN 1795353 A 6/2006

OTHER PUBLICATIONS

Written Opinion and International Search Report dated Jun. 20, 2007 for PCT/US2007/005162.
Chinese Office Action for 200780051885.6, dated Mar. 12, 2010.
Chinese Office Action for CN 200780051885.6, dated Aug. 20, 2010.

* cited by examiner

*Primary Examiner* — Mohammad Ali
(74) *Attorney, Agent, or Firm* — Bachman & LaPointe, P.C.

(57) ABSTRACT

A refrigerant system is configured to alternatingly run in an economized mode and a standard mode. A control system shifts the refrigerant system between the economized mode and standard mode responsive to a determined efficiency reflecting a combination of at least two of: compressor isentropic efficiency; condenser efficiency; evaporator efficiency; efficiency of hardware mechanically powering the compressor; and a mode-associated cycling efficiency. In a bypass mode, a bypass refrigerant flow from an intermediate port may return to the suction port. Shifting into the bypass mode may be similarly controlled based upon the determined efficiency.

20 Claims, 8 Drawing Sheets

REFRIGERANT SYSTEM AND CONTROL METHOD

BACKGROUND OF THE INVENTION

The invention relates to cooling and heating. More particularly, the invention relates to economized air conditioning, heat pump, or refrigeration systems.

U.S. Pat. No. 6,955,059 discloses an economized vapor compression system with different modes of unloading. Additionally, commonly assigned U.S. Pat. No. 4,938,666 discloses unloading one cylinder of a bank by gas bypass and unloading an entire bank by suction cutoff. Commonly assigned U.S. Pat. No. 4,938,029 discloses the unloading of an entire stage of a compressor and the use of an economizer. Commonly assigned U.S. Pat. No. 4,878,818 discloses the use of a valved common port to provide communication with suction for unloading or with discharge for volume index ($V_i$) control, where $V_i$ is equal to the ratio of the volume trapped gas at suction ($V_S$) to the volume of trapped gas remaining in the compression pocket prior to release to discharge. In employing these various methods, the valve structure is normally fully open, fully closed, or the degree of valve opening is modulated so as to remain at a certain fixed position. Commonly assigned U.S. Pat. No. 6,047,556 (the '556 patent, the disclosure of which is incorporated by reference herein in its entirety as if set forth at length) discloses the use of solenoid valve(s) rapidly cycling between fully open and fully closed positions to provide capacity control. The cycling solenoid valve(s) can be located in the compressor suction line, the compressor economizer line and/or the compressor bypass line which connects the economizer line to the suction line. The percentage of time that a valve is open determines the degree of modulation being achieved. U.S. Pat. No. 6,619,062 discloses control of scroll compressor unloading mechanisms based solely upon scroll compressor pressure ratio operation.

Nevertheless there remains room for further improvement in the art.

SUMMARY OF THE INVENTION

One aspect of the disclosure involves a refrigerant system configured to alternatingly run in an economized mode and a standard mode. A control system shifts the refrigerant system between the economized mode and standard mode responsive to a determined efficiency reflecting a combination of at least two of: compressor isentropic efficiency; condenser efficiency; evaporator efficiency; efficiency of hardware mechanically powering the compressor; and a mode-associated cycling efficiency. In a bypass mode, a bypass refrigerant flow from an intermediate port may return to the suction port. Shifting into the bypass mode may be similarly controlled based upon the determined efficiency.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
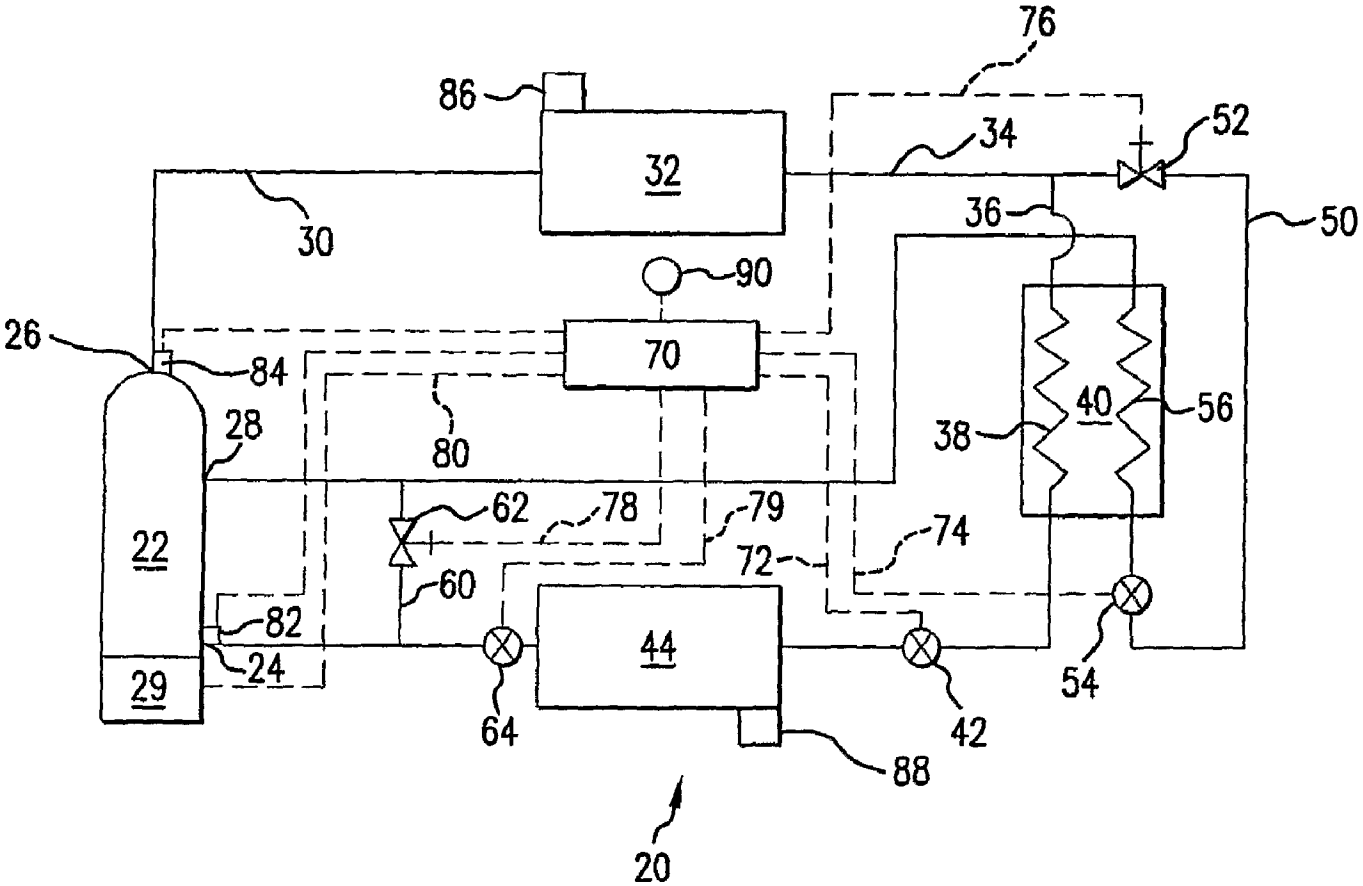
FIG. 1 is a schematic representation of an economized refrigeration or air conditioning system employing the present invention.

FIG. 1 shows an exemplary closed refrigeration or air conditioning system 20. The system has a compressor 22 having suction (inlet) and discharge (outlet) ports 24 and 26 defining a compression path therebetween. The compressor further includes an intermediate port 28 at an intermediate location along the compression path. An exemplary compressor includes a motor 29. An exemplary motor is an electric motor. Alternative motors may comprise internal combustion engines. The other variations include electric motors powered by internal combustion engine generators. An exemplary compressor configuration is a screw-type compressor (although other compressors including scroll compressors, centrifugal compressors, and reciprocating compressors may be used). The compressor may be hermetic, semi-hermetic, or open-drive (where the motor is not within the compressor housing).

A compressor discharge line 30 extends downstream from the discharge port 26 to a heat rejection heat exchanger (e.g., condenser or gas cooler) 32. A trunk 34 of an intermediate line extends downstream from the condenser. A main branch 36 extends from the trunk 34 to a first leg 38 of an economizer heat exchanger (economizer) 40. From the economizer 40, the branch 36 extends to a first expansion device 42. From the expansion device 42, the branch 36 extends to a heat absorption heat exchanger (e.g., evaporator) 44. From the evaporator 44, the branch 36 extends back to the suction port 24. A second branch 50 extends downstream from the trunk 34 to a first valve 52. Therefrom, the branch 50 extends to a second expansion device 54. Therefrom, the branch extends to a second leg 56 of the economizer 40 in heat exchange proximity to the first leg 38. The branch 50 extends downstream from the economizer 40 to the intermediate port 28. A bypass conduit 60, in which a bypass valve 62 is located, extends between the branches (e.g., between a first location on the main branch 36 between the evaporator and suction port and a second location on the second branch 50 between the economizer and intermediate port). Optionally, a suction modulation valve (SMV) 64 may be located downstream of the evaporator (e.g., between the evaporator and the junction of the bypass conduit 60 with the suction line).

Exemplary expansion devices 42 and 54 are electronic expansion devices (EEV) and are illustrated as coupled to a control/monitoring system 70 (e.g., a microprocessor-based controller) for receiving control inputs via control lines 72 and 74, respectively. Alternatively, one or both expansion devices may be thermo-expansion valves (TXV). Similarly, exemplary valves 52 and 62 are solenoid valves and are illustrated as coupled to the control system via control lines 76 and 78, respectively. Alternatively, if the expansion device 54 is an EEV, it may also serve as the valve 52 (e.g., to shut-off flow through the branch 50). The control system may also control the SMV 64 via a control line 79.

The compressor motor 29 may be coupled to the control system 70 via a control line 80. The control system 70 may control motor speed via an appropriate mechanism. For example, the motor may be a multi-speed motor. Alternatively, the motor may be a variable speed motor driven by a variable frequency drive (VFD). Alternatively, an open drive compressor may be directly driven by an engine (motor) having variable engine speed. The exemplary control system may receive inputs such temperature inputs from one or more temperature sensors 82 and 84. Other temperature sensors may be in the temperature-controlled environment or may be positioned to measure conditions of the heat exchangers (e.g., sensors 86 and 88 on the heat exchangers 32 and 44, respectively). Additional or alternative sensors may include sensors indicative of the pressure at compressor suction and discharge locations and/or sensors that are indicative of pressure at the evaporator and/or condenser inlets or outlets. The control system may receive external control inputs from one or more input devices (e.g., thermostats 90). Yet other sensors may be included (e.g., measuring drive voltage or frequency or compressor load).

When used for cooling, the evaporator 44 may be positioned within a space to be cooled or within a flowpath of an airflow to that space. The condenser may be positioned externally (e.g., outdoors) or along a flowpath to the external location. In a heating configuration, the situation may be reversed. In a heat pump system that may provide both configurations, one or more valves (e.g., a four-way reverse valve—not shown) may selectively direct the refrigerant to allow each heat exchanger structure to alternatively be utilized as condenser and evaporator.

The exemplary system has several modes of operation. For ease of reference, a first mode is a standard non-economized (standard) mode. Essentially, in this mode, both valves 52 and 62 are closed such that: refrigerant flow through the second branch 50 and thus the economizer second leg 56 is restricted (e.g., blocked); and refrigerant flow through the bypass conduit 60 is also restricted (e.g., blocked). Thus, refrigerant flow through the intermediate port 28 is minimal or non-existent. Most, if not all, refrigerant flows: from the discharge port 26 to the condenser 32; through the condenser 32; through the economizer first leg 38 (with no heat exchange effect as there is no flow through the second leg); through the first expansion device 42; through the evaporator 44; and back to the suction port 24 to then be recompressed along the compression path. Exemplary compressors used for heating or cooling applications normally have a peak efficiency at a system operating point corresponding to the built-in compressor volume ratio. Near this point, the pressure in the compression pocket at the end of compression is equal to or nearly equal to the discharge plenum pressure. When these pressures are equal, there are no over-compression or under-compression losses. This point occurs when the system density ratio (the density $\rho_D$ of refrigerant on the system high side divided by the density $\rho_S$ of refrigerant on the system low side) is equal to the compressor built-in volume ratio (compressor suction volume divided by discharge volume). Use of system density ratio may be more effective in determining optimal compressor operation than use of a system pressure ratio (pressure on the high side divided by pressure on the low side). The system pressure ratio may be less related to the compressor volume ratio. For a given compressor mode of operation, there may be multiple pressure ratios which, depending upon the suction and/or discharge temperature, would correspond to the built-in volume ratio whereas there is a single density ratio corresponding to the built-in volume ratio.

Figure 2:
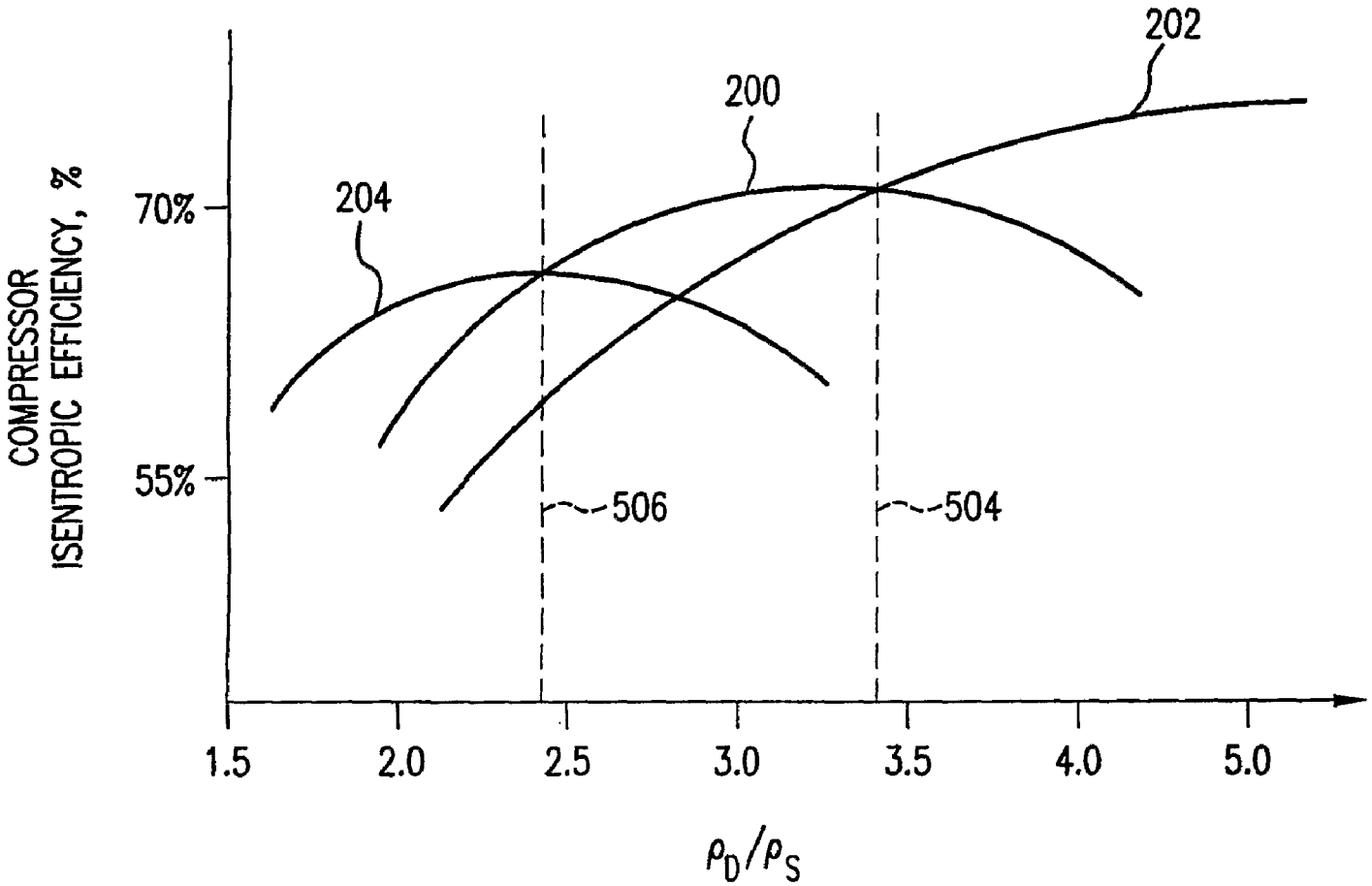
FIG. 2 is a series of plots of compressor isentropic efficiency against density ratio for the system of FIG. 1.

The optimal compressor volume ratio may vary depending upon the compressor mode of operation. If the compressor is operated in an unloaded mode wherein part of the refrigerant from an intermediate location along the compression path is bypassed back to suction conditions, an optimal volume ratio may be reduced relative to a standard mode of operation. Similarly, if additional refrigerant is returned to the compressor at the intermediate location, the optimal value of volume ratio would be generally higher relative to the standard mode. FIG. 2 shows a plot 200 of compressor isentropic efficiency $\eta_{ISENTROPIC_COMPRESSOR}$ (%) against density ratio for standard mode operation.

A second mode of operation is an economized mode. Generally, in the economized mode, the first valve 52 is open and the second valve 62 is closed. Flow from the compressor is split, with a main portion flowing through the main branch 36 as in the standard mode. An economizer portion, however, flows through the second branch 50, passing through the valve 52 and economizer second leg 56 wherein it exchanges heat with the refrigerant in the first leg 38. In this mode, the economizer 40 provides additional subcooling to the refrigerant along the first leg 38. The additional subcooling increases the system capacity and thus provides more system cooling (e.g., of the space being cooled) in the cooling mode and heating in the heating mode. Therefrom, the economizer flow returns to the intermediate port 28 to be injected (as vapor) into and recompressed along the downstream portion of the compression path. FIG. 2 further shows a plot 202 of economized mode compressor isentropic efficiency against density ratio. Above an approximate density ratio 504, the economized mode offers higher compressor efficiency than the standard mode.

A third mode is a bypass mode. Generally, in the bypass mode, the valve 52 is closed and the valve 62 is open. Additionally, an intermediate pressure relief bypass flow will, in the illustrated embodiment, exit the intermediate port 28 and pass through the bypass conduit 60 to return to the suction port 24. FIG. 2 further shows a plot 204 of compressor isentropic efficiency against density ratio for the bypass mode. Below a ratio 506, the bypass mode offers a higher compressor isentropic efficiency than the standard and economized modes. In the exemplary embodiment, 506 is less than 504 and, therefore, intermediate these density ratios the standard mode offers higher compressor efficiency than the bypass and economized modes.

Figure 3:
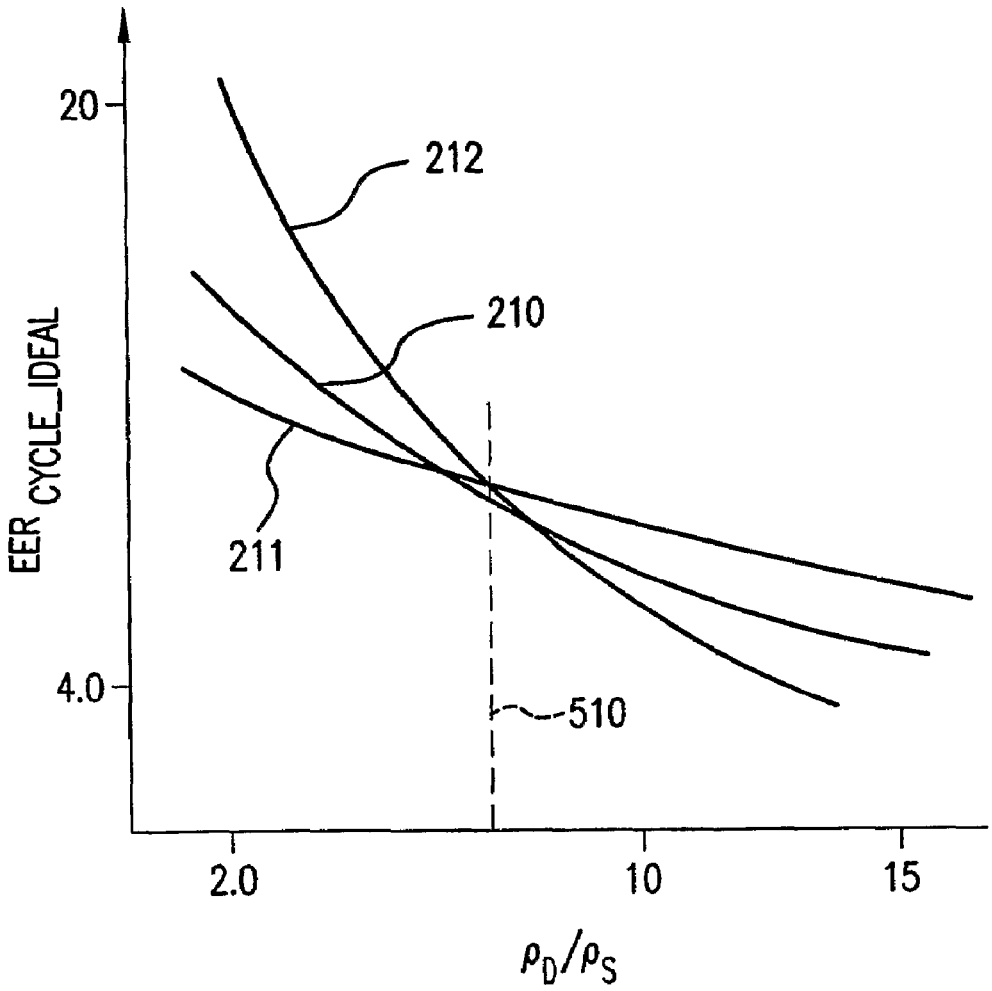
FIG. 3 is a series of plots of ideal EER against the density ratio.

To determine the most efficient mode of operation for a given system operating condition, other factor or factors beyond compressor isentropic efficiency are taken into account. FIG. 3 shows ideal cycle efficiency (e.g., with no losses in the compressor, motor, or other associated components, and with infinitely large heat exchanger coils) as a function of density ratio at a constant discharge pressure. Plots 210, 211, and 212 respectively identify standard, economized, and bypass modes. The ideal system efficiency is expressed in terms of EER (ideal system capacity divided by compressor power for a compressor operating at 100% efficiency). The economized mode has the highest cycle efficiency in a high density ratio domain above a ratio 510. The bypass mode has the highest efficiency in a lower density ratio domain (e.g., below the ratio 510). In the example, the standard mode efficiency is never above the higher of the bypass and economized mode efficiencies. However, other variations may differ.

Figure 4:
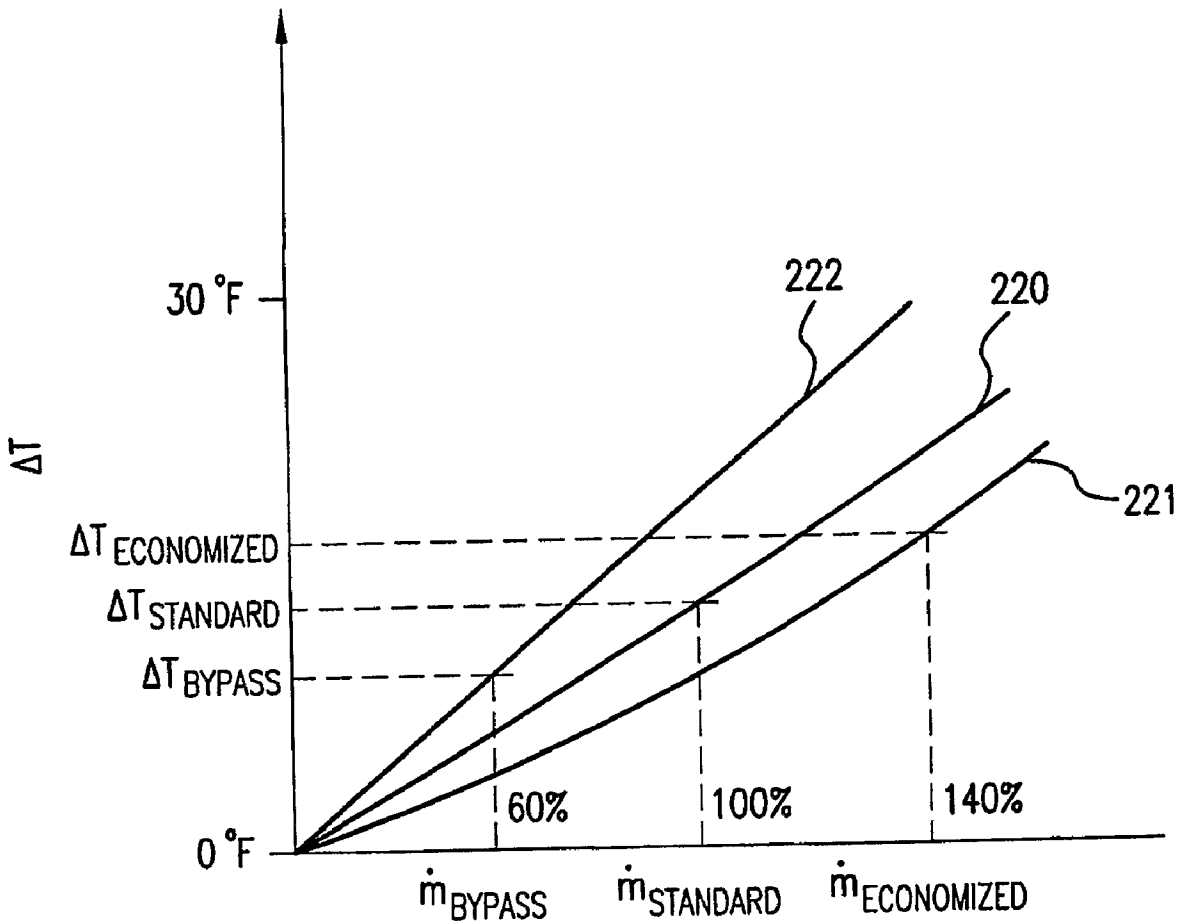
FIG. 4 is a series of plots of condenser temperature differential against mass flow rate.
Figure 5:
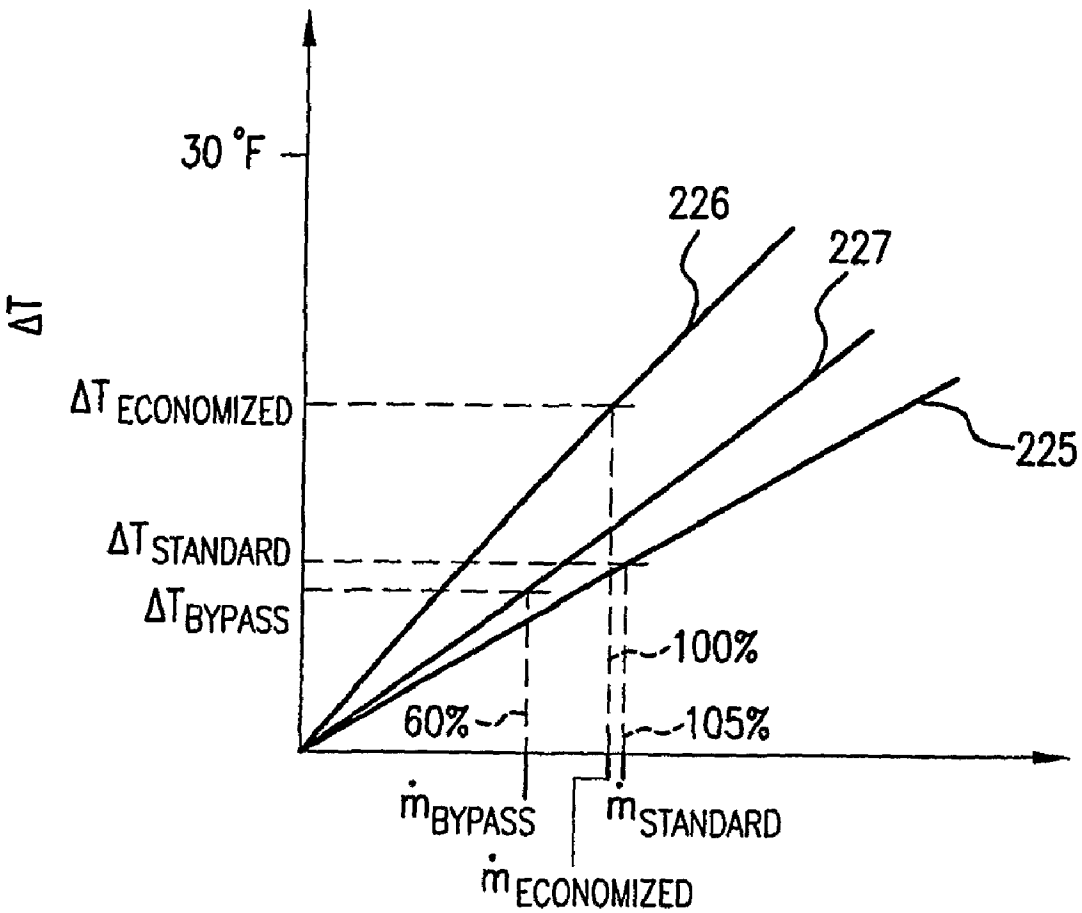
FIG. 5 is a series of plots of evaporator temperature differential against mass flow rate.

Additionally, the mass flow rate $\dot{m}$ of refrigerant in through the heat exchangers may be considered in determining the most efficient mode. FIGS. 4 and 5 respectively relate to temperature differential ΔT across the condenser and evaporator for a fixed ambient temperature and fixed temperature of the conditioned environment.

Where ΔT is the absolute temperature difference between the saturated temperature of the refrigerant in a heat exchanger and the air temperature downstream of the heat exchanger. FIG. 4 shows the temperature differential as a function of refrigerant mass flow rate $\dot{m}$ through the condenser. A plot 220 shows ΔT for the standard mode, a plot 221 shows the economized mode, and a plot 222 shows the bypass mode. The mass flow rate $\dot{m}$ can be varied, for example, by driving the compressor at various operating speeds.

FIG. 5 shows temperature differential as a function of mass flow rate through the evaporator. A plot 225 shows the evaporator ΔT for the standard mode, a plot 226 shows the economized mode, and a plot 227 shows the bypass mode. The temperature differential is illustrated for a specific compressor operating speed. As shown, for example, FIG. 4, for the chosen operating speed the mass flow rate through the condenser at by-pass mode is ~60% of the standard mode, and the mass flow rate at economized mode is ~140% of the standard mode (the difference between the mass flow rates at different modes is shown for illustration purpose, only, as the exact percentages would vary with a specific compressor type and system operating condition). Similarly, for FIG. 5, the mass flow rate for the same operating speed through the evaporator at by-pass mode is ~60% of the economized mode, and mass flow rate at standard mode is ~105% of the economized mode.

Figure 6:
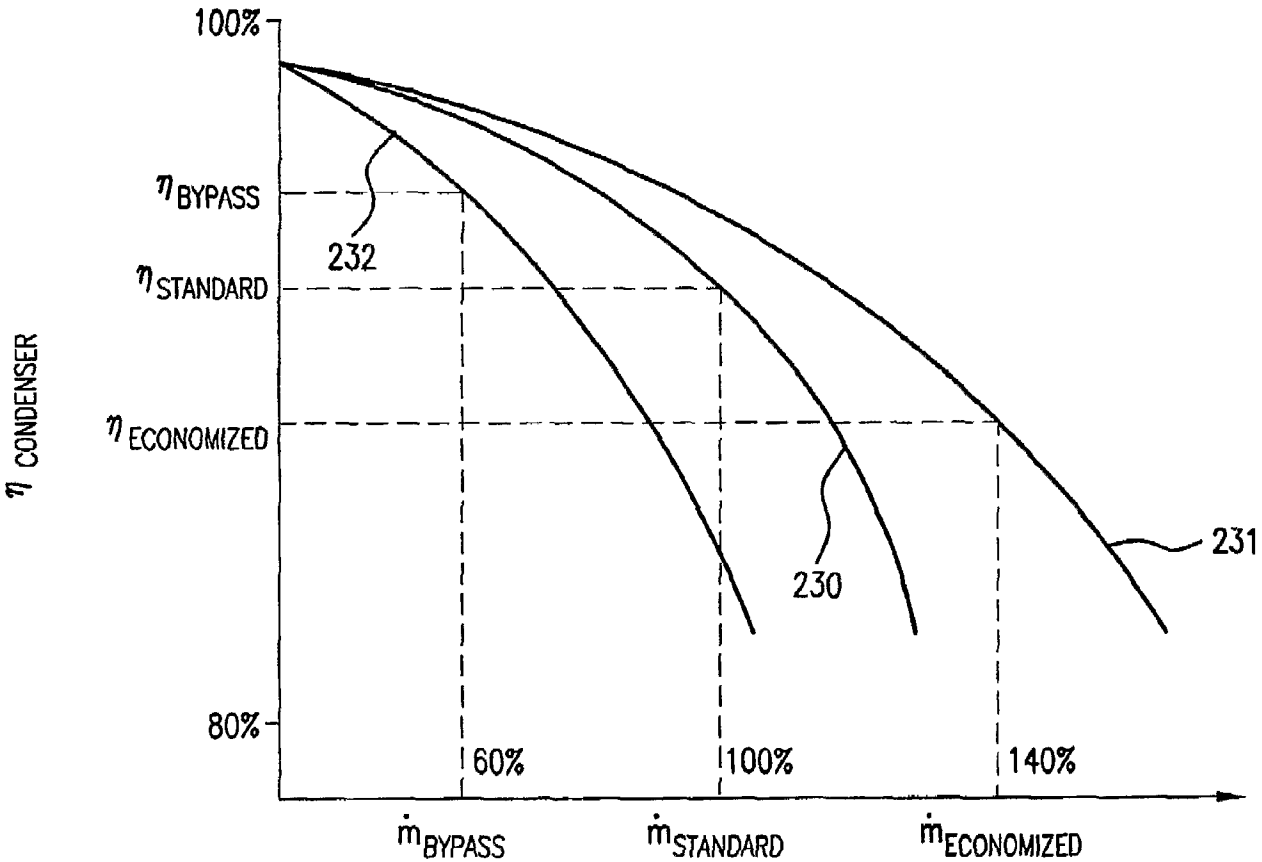
FIG. 6 is a series of plots of condenser efficiency against mass flow rate.
Figure 7:
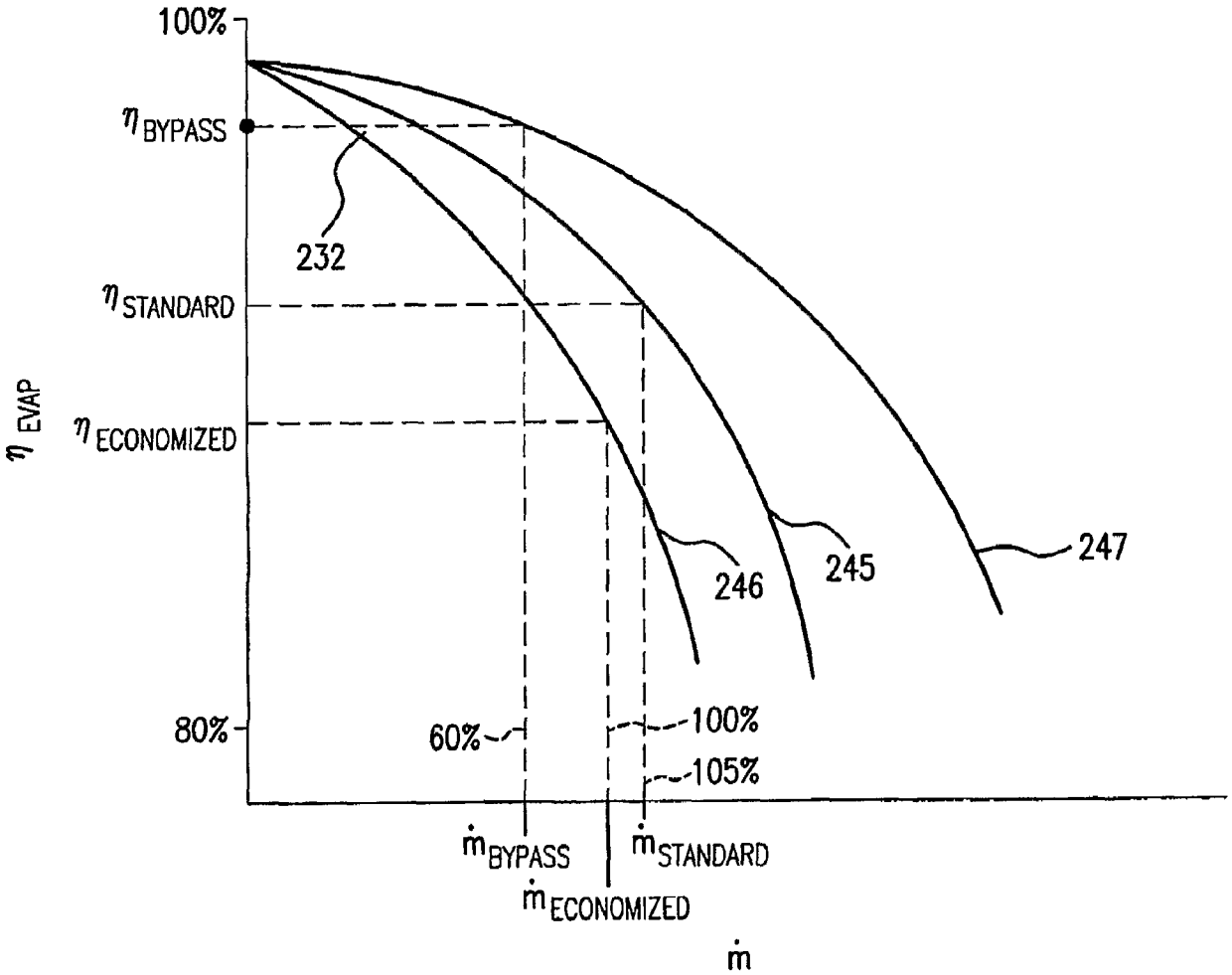
FIG. 7 is a series of plots of evaporator efficiency against mass flow rate.

Higher temperature differential is associated with a less efficient heat exchanger or less efficient operation. For example, an ideal heat exchanger would be 100% efficient and have infinitely large heat exchange surfaces, zero temperature differential and no pressure drop losses. FIGS. 6 and 7 show heat exchanger efficiency for the condenser and evaporator, respectively for a fixed ambient temperature and fixed temperature of the conditioned environment where the efficiency is plotted against refrigerant mass flow. In FIG. 6, plots 230, 231, and 232 are respectively associated with the standard, economized, and bypass modes. Similarly, in FIG. 7, plots 235, 236, and 237 identify evaporator efficiencies the standard, economized, and bypass modes. The efficiency of each mode is also illustrated for a chosen specific compressor operating speed. Each combination of ambient temperature and temperature of the conditioned environment will have unique graphs similar to those illustrated in FIGS. 4-7. In setting the controller programming (e.g., one or more of hardware, software or entered setting), the system designer may analyze these graphs for each ambient temperature and temperature of the conditioned environment to select the most efficient mode of operation, considering the constraints of required system capacity. The controller may be so programmed or configured to operate the system in to shift the system between the modes responsive to a determined efficiency reflecting a combination of efficiency components including those above and those discussed below.

As shown in the above examples, the heat exchangers operate less efficiently as the mass flow rate through the heat exchangers is increased (the heat exchangers become more "loaded" as well as additional pressure drop loss being introduced as refrigerant mass flow rate is increased.

Figure 8:
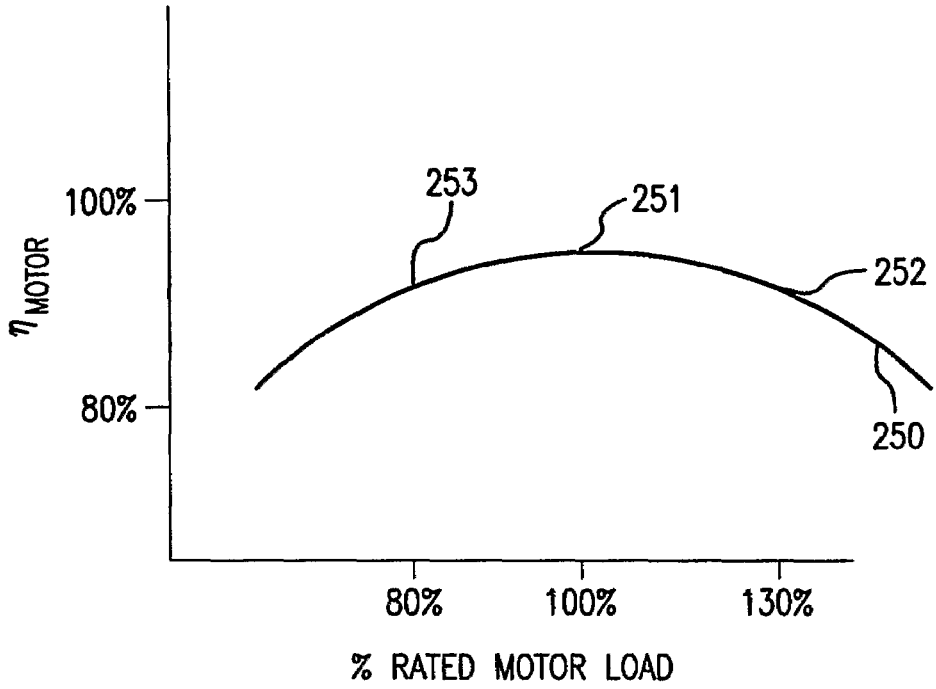
FIG. 8 is a plot of motor efficiency against load.

Other factors may include losses associated with the motor (e.g., with an electric motor and its variable frequency drive). FIG. 8 shows a plot 250 motor efficiency $\eta_{MOTOR}$ as a function of load (% of rated load). Each of the three exemplary modes: standard; economized; and bypass will load the motor differently. Points 251, 252, and 253 respectively identify the loads associated with the standard, economized, and bypass modes.

Figure 9:
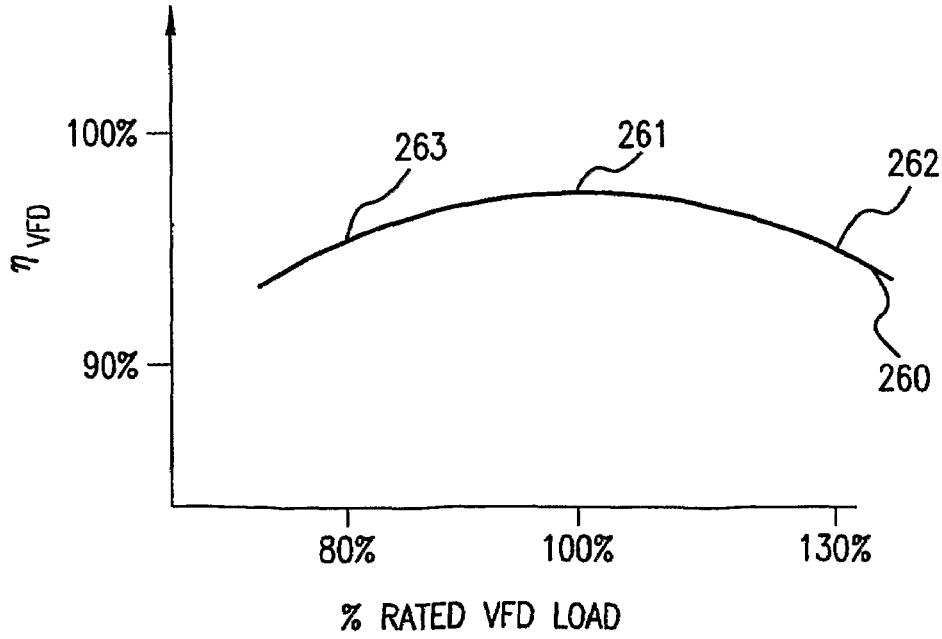
FIG. 9 is a plot of variable frequency drive efficiency against load.

FIG. 9 shows a plot 260 of variable frequency drive efficiency $\eta_{VFD}$ as a function of VFD load (e.g., % of rated VFD load). The rated VFD load may or may not correspond to the rated motor load. The correspondence will depend on how and how well the VFD and motor load characteristics are matched. Points 261, 262, and 263 respectively identify the loads associated with the standard, economized, and bypass modes. If the compressor is driven by an engine (either directly or indirectly) then the engine efficiency may be considered in lieu of or along with the motor efficiency for the various modes of operation. Additionally, the effective cycling losses can also be considered. For example, the identified modes of operation may be subject to different degrees of cycling and cycling may have different effects upon each mode. For example, in the economized mode, the system would be expected to cycle more frequently than in the bypass mode. This is because in the economized mode of operation more cooling capacity is generated than in the standard mode or bypass mode. Therefore, to match the generated capacity to the required capacity, the system would need to cycle on and off more frequently in the economized mode than in the bypass mode. Accordingly, a cycling efficiency factor $\eta_{CYCLING}$ may be considered. For example, if the system operates continuously, the cycling efficiency is 100%. Accordingly, an overall EER value may be calculated based upon an ideal EER value modified by the various efficiencies discussed above:

$$EER_{OVERALL}=EER_{CYCLE_IDEAL}\cdot\eta_{ISENTROPIC_COMPRESSOR}\cdot\eta_{EVPORATOR}\cdot\eta_{CONDENSER}\cdot\eta_{MOTOR}\cdot\eta_{VFD}\cdot\eta_{CYCLING}$$

Some of these factors or their associated components may be unknown to a system designer. For example, at the time of designing/selecting the compressor, the particular variable frequency drive efficiency may be unknown. Such unknown factors may be ignored or merely estimated. In a basic example, only the compressor isentropic efficiency is considered and the other efficiencies are neglected. This basic example yields an exemplary method of operation involving operating the system: in the bypass mode below the density ratio 506; in the standard mode between the density ratios 506 and 504; and in the economized mode above the density ratio 504. Rough exemplary values for one implementation involve density ratios 506 and 504 of about 2.9 and about 3.25, respectively.

One or more embodiments of the present invention have been described. Nevertheless, it will be understood that various modifications may be made without departing from the spirit and scope of the invention. For example, when implemented as a modification or a reengineering of an existing system, details of the existing system may heavily influence details of the implementation. Accordingly, other embodiments are within the scope of the following claims.

What is claimed is:

1. An apparatus (20) comprising:

a compressor (22) having a suction port (24), a discharge port (26), and an intermediate port (28);

a condenser (32);

an evaporator (44);

an economizer heat exchanger (40);

a conduit system:

coupling the condenser to the discharge port;

coupling the economizer heat exchanger to the condenser;

cooperating with the economizer heat exchanger and the evaporator to define a first flow path between the economizer heat exchanger and the suction port;

cooperating with the economizer heat exchanger to define a second flow path between the economizer heat exchanger and the intermediate port, bypassing the evaporator;

having one or more valves for selectively blocking and unblocking the second flow path; and a control system (70):

coupled to the one or more valves and configured to alternately operate the apparatus in a plurality of modes including:

a standard mode essentially wherein a refrigerant flow from the condenser passes along the first flowpath and not the second flowpath; and an economized mode essentially wherein a refrigerant flow splits into:

a first portion passing along the first flow path; and a second portion extending through the second flow path section to return to the intermediate port; and configured to shift the apparatus between the modes responsive to a determined efficiency reflecting a combination of at least two of:

compressor isentropic efficiency;

condenser efficiency;

evaporator efficiency;

efficiency of hardware mechanically powering the compressor; and a mode-associated cycling efficiency.

2. The apparatus of claim 1 wherein:

the control system is configured to determine the efficiency reflecting a combination of at least three of said:

compressor isentropic efficiency;

condenser efficiency;

evaporator efficiency;

efficiency of hardware mechanically powering the compressor; and a mode-associated cycling efficiency.

3. The apparatus of claim 1 wherein:

the plurality of modes further includes:

a bypass mode essentially wherein a refrigerant flow passes along the first flow path and a bypass flow of refrigerant from the intermediate port returns to the suction port.

4. The apparatus of claim 1 wherein:

said efficiency of hardware mechanically powering the compressor comprises a combination of electric motor efficiency and variable frequency drive efficiency.

5. The apparatus of claim 1 wherein:

the controller is configured to determine a refrigerant density ratio and determine said compressor isentropic efficiency responsive to the determined refrigerant density ratio.

6. The apparatus of claim 5 wherein:

the controller is configured to determine said refrigerant density ratio based upon a combination of: compressor suction temperature; compressor suction pressure; compressor discharge temperature; and compressor discharge pressure.

7. The apparatus of claim 1 wherein:

at least a first of the one or more valves is a solenoid valve.

8. The apparatus of claim 1 wherein:

the one or more valves are bistatic.

9. The apparatus of claim 1 wherein:

the compressor is a screw compressor.

10. A method for operating a cooling system, the system having:

a compressor having a suction port, a discharge port, and an intermediate port;

a condenser having an inlet and an outlet, the condenser inlet coupled to the discharge port;

an evaporator having an inlet and an outlet, the evaporator outlet coupled to the compressor suction port; and an economizer first and second flow path sections;

the method comprising:

determining a most efficient mode of a plurality of modes, the determining including determining efficiency factors associated with at least two of:

compressor isentropic efficiency;

condenser efficiency;

evaporator efficiency;

efficiency of hardware mechanically powering the compressor; and a mode-associated cycling efficiency; and responsive to the determining, at different times:

running the system in an economized mode wherein a refrigerant flow from the discharge port proceeds essentially through the condenser, splitting into a first portion extending through the first flow path section and evaporator to return to the suction port and a second portion extending through the second flow path section to return to the intermediate port; and running the system in a non-economized mode wherein a refrigerant flow from the discharge port proceeds essentially through the condenser, first flow path section and evaporator to return to the suction port.

11. The method of claim 10 further comprising:

running the system in a bypass mode wherein a refrigerant flow from the discharge port proceeds essentially through the condenser, first flow path section and evaporator to return to the suction port and a bypass flow of refrigerant from the intermediate port returns to the suction port.

12. The method of claim 10 wherein:

the determining includes determining at least three said efficiency factors.

13. The method of claim 10 further comprising:

sensing least one operational parameter selected from the group consisting of:

saturated evaporating temperature;

saturated evaporating pressure;

air temperature entering or leaving the evaporator;

saturated condensing temperature;

saturated condensing pressure;

air temperature entering or leaving the condenser;

compressor current;

compressor voltage; and compressor power; and selecting one of said modes responsive to the at least one operational parameter.

14. A system comprising:

a compressor;

a condenser;

an evaporator;

an economizer;

first means coupling the evaporator and economizer to the compressor and condenser for alternatingly operating the system in:

a standard mode; and an economized mode; and second means for determining respective efficiencies of the standard mode and economized mode and coupled to the first means to shift between said standard mode and said economized mode responsive to said determined efficiencies.

15. The system of claim 14 wherein:

the second means is configured to control the first means to alternatingly operate the system in said standard mode, said economized mode, and a bypass mode.

16. The system of claim 15 wherein:

the second means is configured to determine said respective efficiencies reflecting a combination of at least two of:

compressor isentropic efficiency;

condenser efficiency;

evaporator efficiency;

efficiency of hardware mechanically powering the compressor; and a mode-associated cycling efficiency.

17. The system of claim 14 wherein:

the second means is configured to determine said respective efficiencies reflecting a combination of at least two of:

compressor isentropic efficiency;

condenser efficiency;

evaporator efficiency;

efficiency of hardware mechanically powering the compressor; and a mode-associated cycling efficiency.

18. The system of claim 14 wherein:

the second means is configured to determine said respective efficiencies reflecting a combination of at least three of:

compressor isentropic efficiency;

condenser efficiency;

evaporator efficiency;

efficiency of hardware mechanically powering the compressor; and a mode-associated cycling efficiency.

19. The system of claim 14 wherein:

the second means is configured to determine said respective efficiencies reflecting a combination of at least four of:

compressor isentropic efficiency;

condenser efficiency;

evaporator efficiency;

efficiency of hardware mechanically powering the compressor; and a mode-associated cycling efficiency.

20. The system of claim 14 wherein:

the second means is configured to determine said respective efficiencies reflecting a combination of at least all of:

compressor isentropic efficiency;

condenser efficiency;

evaporator efficiency;

efficiency of hardware mechanically powering the compressor; and a mode-associated cycling efficiency.

* * * * *